US010203146B2

(12) United States Patent
Jung

(10) Patent No.: US 10,203,146 B2
(45) Date of Patent: Feb. 12, 2019

(54) REFRIGERATOR

(71) Applicant: LG ELECTRONICS INC., Seoul (KR)

(72) Inventor: Yongrak Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 2 days.

(21) Appl. No.: 15/405,539

(22) Filed: Jan. 13, 2017

(65) Prior Publication Data

US 2017/0198961 A1 Jul. 13, 2017

(30) Foreign Application Priority Data

Jan. 13, 2016 (KR) ..... 10-2016-0004340

(51) Int. Cl.

| | |
|---|---|
| ***F25D 17/06*** | (2006.01) |
| ***F25B 39/00*** | (2006.01) |
| ***F25D 11/02*** | (2006.01) |
| *F25B 39/02* | (2006.01) |

(52) U.S. Cl.

CPC ..... *F25D 17/067* (2013.01); *F25B 39/00* (2013.01); *F25D 11/02* (2013.01); *F25D 17/065* (2013.01); *F25B 39/02* (2013.01); *F25D 2317/0672* (2013.01)

(58) Field of Classification Search

CPC ..... F25D 17/067; F25D 17/065; F25D 11/02; F25D 2317/0672; F25B 39/00; F25B 39/02

See application file for complete search history.

(56) References Cited

U.S. PATENT DOCUMENTS

| | | | |
|---|---|---|---|
| 6,675,603 | B1 | 1/2004 | Lesyna et al. |
| 2008/0156029 | A1 | 7/2008 | Ritchie et al. |
| 2012/0011879 | A1 | 1/2012 | Gu |

FOREIGN PATENT DOCUMENTS

| | | | |
|---|---|---|---|
| EP | 0452977 | | 10/1991 |
| EP | 1928471 | | 3/2007 |
| JP | 2007071465 A | * | 3/2007 |
| WO | 200026589 | | 5/2000 |
| WO | 2010029041 | | 3/2010 |

OTHER PUBLICATIONS

Extended European Search Report in European Application No. 17151208.0, dated Apr. 24, 2017, 7 pages (with English translation).

* cited by examiner

*Primary Examiner* — Emmanuel Duke
(74) *Attorney, Agent, or Firm* — Fish & Richardson P.C.

(57) ABSTRACT

A refrigerator that includes a storage compartment; a pantry that includes an interior area; an evaporator that is configured to cool air; a cover that is coupled to the evaporator, that is configured to isolate the interior of the pantry from the evaporator, and that includes a through hole, the through hole being configured to enable flow of air from the evaporator to the interior area of the pantry; a duct structure that is coupled to a first surface of the cover, that is configured to cover the through hole, and that includes a cold air vent protruding toward the interior area of the pantry; and a pantry fan that is coupled to the duct structure and that is configured to provide air cooled by the evaporator to the interior area of pantry through the cold air vent of the duct structure is disclosed.

20 Claims, 8 Drawing Sheets

REFRIGERATOR

CROSS-REFERENCE TO RELATED APPLICATION

Pursuant to 35 U.S.C. § 119(a), this application claims the benefit of an earlier filing date of and the right of priority to Korean Application No. 10-2016-0004340, filed on Jan. 13, 2016, the contents of which are incorporated by reference herein in its entirety.

TECHNICAL FIELD

The present application generally relates to technologies about a refrigerator.

BACKGROUND

A refrigerator is an appliance for freezing or chilling foodstuffs and storing them in it. The refrigerator consists of a main refrigerator body with a food storage compartment in it and refrigeration cycle equipment for refrigeration. The refrigeration cycle equipment consists of a compressor, a condenser, an expander, and an evaporator. In general, a machine room is provided at the rear of the main refrigerator body, and the compressor and condenser of the refrigeration cycle equipment are installed in the machine room.

SUMMARY

The present disclosure is generally related to a refrigerator.

In general, one innovative aspect of the subject matter described in this specification can be embodied in a refrigerator including: a storage compartment; a pantry that is located in the storage compartment and that includes an interior area; an evaporator that is coupled to the storage compartment and that is configured to cool air; a cover that is coupled to the evaporator, that is configured to isolate the interior of the pantry from the evaporator, and that includes a through hole, the through hole being configured to enable flow of air from the evaporator to the interior area of the pantry; a duct structure that is coupled to a first surface of the cover, that is configured to cover the through hole, and that includes a cold air vent protruding toward the interior area of the pantry; and a pantry fan that is coupled to the duct structure and that is configured to provide air cooled by the evaporator to the interior area of pantry through the cold air vent of the duct structure.

The foregoing and other embodiments can each optionally include one or more of the following features, alone or in combination. In particular, one embodiment includes all the following features in combination. The duct structure includes: a perimeter portion that surrounds the cold air vent and that includes a first perimeter portion and a second perimeter portion, and wherein the first perimeter portion protrudes toward the interior area of the pantry more than the second perimeter portion. The cold air vent includes: a first cold air vent that corresponds to the first perimeter portion, and a second cold air vent that corresponds to the second perimeter portion, and wherein either the first cold air vent or the second cold air vent is at least partly blocked. The duct structure includes: a first portion that faces the pantry fan, that is configured to guide air provided from the pantry fan to the cold air vent, and that includes a slope or a curve. The refrigerator further includes a drawer that is located at a first side of the pantry and that includes a first surface facing the duct structure, the first surface including a slope or a curve, wherein the cold air vent is located between the pantry and the drawer. The pantry includes: a first surface that faces the cover and that includes a dented portion, the dented portion being configured to accept the duct structure. The refrigerator further includes a duct insulation part that is coupled between the pantry fan and the duct structure, that is configured to at least partly surround a perimeter of the pantry fan, and that includes a hole, the hole being configured to enable flow of air from the evaporator to the cold air vent. The duct insulation part includes: a first portion that faces the pantry fan and that includes a slope or a curve. The duct insulation part includes: a slot that is located in a bottom area of the duct insulation part and that is configured to drain water through a drainage passage. The duct structure includes: a drainage area that is located in a bottom area of the duct structure and that is configured to collect water drained through the drainage passage. The drainage area includes: a slope that slopes toward the through hole and that is configured to drain water collected in the drainage area. The refrigerator further includes a cover insulation part that is coupled to a second surface of the cover, the cover insulation part including: an opening that is located in an area of the cover insulation part corresponding to the through hole of the cover, and a slot that is located in a bottom area of the cover insulation part and that is configured to drain water through a drainage passage. The refrigerator further includes a drainage area that is located below the cover insulation part and that is configured to collect water drained through the drainage passage. The drainage area includes: a slope that is configured to drain the water collected in the drainage area. The duct structure includes: a drainage area that is located in a bottom area of the duct structure and that is configured to collect water. The drainage area includes: a slope that slopes toward the through hole and that is configured to drain water collected in the drainage area. The pantry fan is an axial fan that is configured to move air in an axial direction. The refrigerator further includes a storage compartment cold air vent that is located on a surface of the storage compartment or on a surface of the cover; a storage compartment fan that is coupled to the surface of the storage compartment or to the surface of the cover and that is configured to move air cooled by the evaporator in a circumferential direction, through the evaporator, to the storage compartment cold air vent; a storage compartment cold airflow path that surrounds a perimeter of the storage compartment fan, and that extends from the perimeter of the storage compartment fan to the storage compartment cold air vent; and a first pantry fan that is located outside the storage compartment cold airflow path and that is configured to provide air cooled by the evaporator to the pantry through a cold airflow path, the cold airflow path being separate from the storage compartment cold airflow path. The evaporator includes: a plurality of refrigerant pipes, each of the plurality of refrigerant pipes including a respective row portion, and a plurality of air intakes that are configured to draw interior air in the interior area of the pantry and provide the interior air to an area adjacent to a second surface of the cover, and wherein the row portions of the plurality of refrigerant pipes includes a first group of row portions that is adjacent to the duct structure and a second group of row portions that is adjacent to the plurality of air intakes. The cover includes: a plurality of ridges that protrude toward the through hole and that support the duct structure.

The subject matter described in this specification can be implemented in particular embodiments so as to realize one or more of the following advantages. Comparing to a conventional refrigerator, a refrigerator includes a low-temperature food storage space for storing low-temperature food. For example, the low-temperature food storage space can be implemented as a pantry. The cold air generated by heat transfer across the evaporator is moved by the pantry fan and then supplied directly to the pantry via the cold air vent of the duct structure. Thus, the internal temperature of the pantry may be kept lower than the average temperature of the refrigerator compartment.

In addition, since the cold air vent of the duct structure has a slanted shape, cold air may be supplied to the center of the pantry from the off-centered duct structure. Also, since the part of the duct structure is blocked, cold air may be supplied to the center of the pantry from the off-centered duct structure.

The duct structure slopes or curves down from the pantry fan, and this makes enough space for cold airflow at the front of the pantry fan. This prevents cold air, which is supposed to be supplied to the pantry, from flowing backwards due to the suction force of the fan of the food storage compartment, and cold air may be moved by the pantry fan and supplied directly to the pantry. Also, the back wall of the drawer facing the outside of the duct structure slopes or curves, corresponding to the front portion of the duct structure, thereby preventing structural interference between the duct structure and the drawer.

Furthermore, the duct insulation slopes or curves down from the pantry fan, and this makes enough space for cold airflow at the front of the pantry fan. This prevents cold air, which is supposed to be supplied to the pantry, from flowing backwards due to the suction force of the fan of the food storage compartment, and cold air may be moved by the pantry fan and supplied directly to the pantry.

At least part of the duct structure, duct insulation, and cover insulation have a drainage passage or drainage area, and this prevents malfunction because water collected in a component for supplying cold air to the pantry is released immediately.

A cold airflow path for supplying cold air directly to the pantry and a food storage compartment cold airflow path for supplying cold air to the food storage compartment are in a dual configuration. This can solve the problem of cold air loss, which may occur in a single cold airflow path configuration, and allows large enough volumes of cold air to the food storage compartment and the pantry.

An evaporator consisting of a plurality of rows includes upper rows and lower rows, and the duct structure is positioned to correspond to the upper rows and the air intakes are positioned to correspond to the lower rows. With this structure, the air drawn into the evaporator from the pantry may get cold by heat transfer across the evaporator for a sufficient amount of time, and the cold air may be circulated back through the duct structure.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
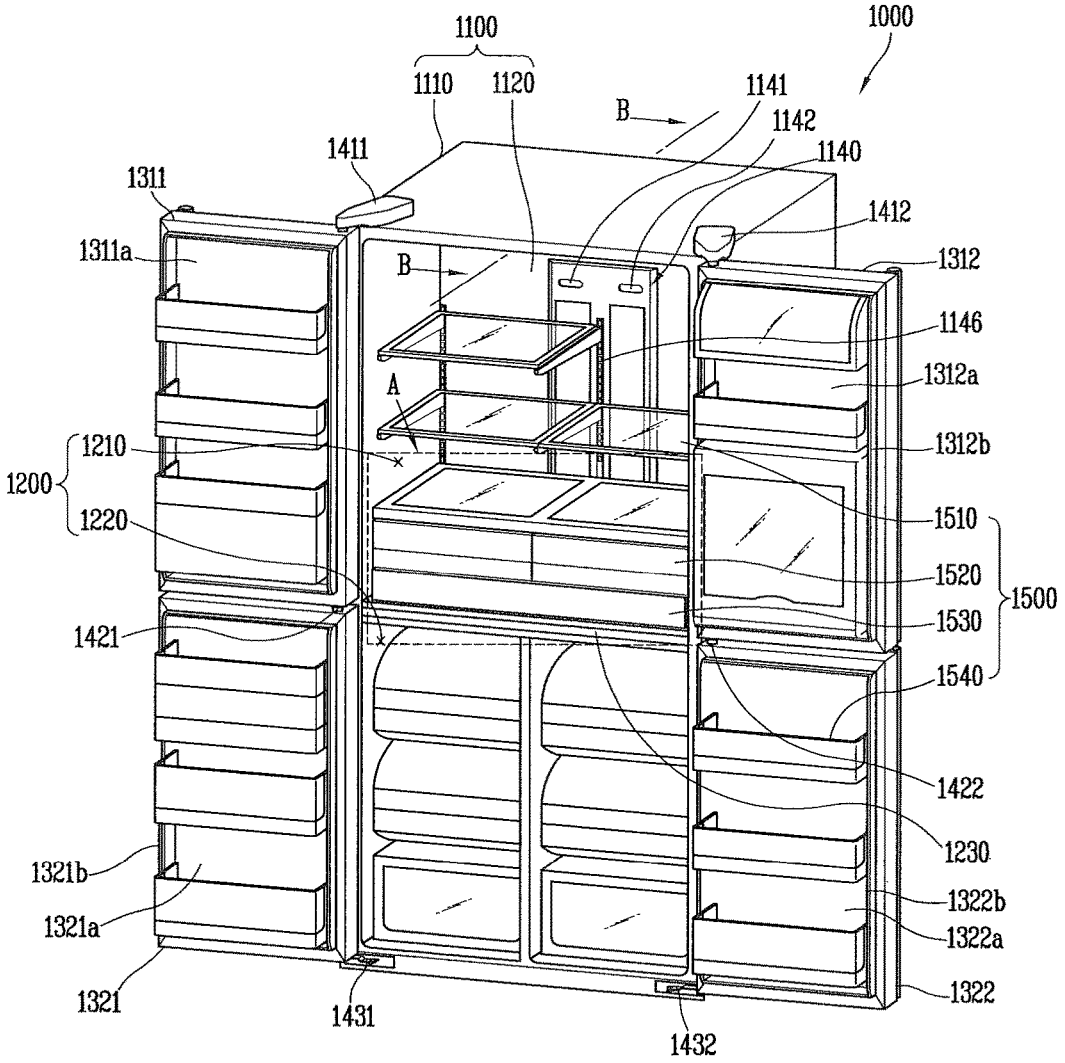
FIG. 1 is a diagram illustrating an example refrigerator.

FIG. 1 illustrates an example refrigerator 1000. The exterior of a refrigerator 1000 is formed by a main refrigerator body 1100 and doors 1311, 1312, 1321, and 1322. The main refrigerator body 1100 includes an outer casing 1110 and an inner casing 1120.

The outer casing 1110 forms the exterior of the refrigerator 1000 except the front of the refrigerator 1000 formed by the doors 1311, 1312, 1321, and 1322. The top and side of the refrigerator 1000 shown in FIG. 1 all correspond to the outer casing 1110.

The inner casing 1120 is located within the main refrigerator body 1100. The inner casing 1120 forms a food storage compartment 1200 in the refrigerator 1000. The food storage compartment 1200 may be divided into a refrigerator compartment 1210 and a freezer compartment 1220 based on temperature setting.

FIG. 1 shows a bottom freezer type refrigerator 1000 which has a refrigerator compartment 1210 provided in the upper part of the refrigerator 1100 and a freezer compartment 1220 provided in the lower part. In some implementations, the refrigerator can be a side-by-side type refrigerator with a refrigerator compartment and a freezer compartment that are respectively located on the left side and the right side. In some other implementations, the refrigerator can be a top mount type refrigerator with a freezer compartment located over a refrigerator compartment. The refrigerator can be any type of refrigerator and not limited to the examples described above.

The inner casing 1120 forms the inside walls of the food storage compartment 1200. The inner casing 1120 may be divided based on position. For instance, FIG. 1 illustrates the refrigerator compartment 1200's sidewalls and back wall.

The insulation 1130 (see FIG. 7) fills in the space between the outer casing 1110 and the inner casing 1120. The insulation is formed by a foaming process.

Covers 1140 and 1150 (see FIG. 2) is attached to the back wall of the refrigerator compartment 1210. The covers 1140 and 1150 (see FIG. 2) include a first cover 1140 and a second cover 1150 (see FIG. 2). The second cover, although not shown in FIG. 1 because it is blocked by a drawer 1520 and a pantry 1530, is shown in the figures to be discussed later (e.g., FIG. 2). The space behind the refrigerator compartment 1120 is visually blocked by the back wall and the cover 1140 and 1150 (see FIG. 2).

A refrigerator compartment cold airflow path 1147 (see FIG. 5) for supplying cold air to the refrigerator compartment 1210 is provided in the space visually blocked by the first cover 1140. The first cover 1140 has refrigerator compartment cold air vents 1141 and 1142 that open towards the food storage compartment 1200. A refrigerator compartment fan 1160 (see FIGS. 5 and 8) is installed at the back of the first cover 1140, and the cold air generated by the refrigerator compartment fan flows along the refrigerator compartment airflow path 1147 behind the first cover 1140, and is supplied to the refrigerator compartment 1210 via the refrigerator compartment cold air vents 1141 and 1142.

The configuration of the refrigerator compartment cold airflow path, refrigerator compartment fan, and refrigerator compartment cold air vents may also apply to cold air supply to the freezer compartment. In this case, the components of the freezer compartment may be named a freezing compartment cold airflow path, a freezing compartment fan, and freezing compartment cold air vents. Also, the term "food storage compartment airflow path" may encompass the refrigerator compartment airflow path and the freezer compartment airflow path, the term "food storage compartment fan" may encompass the refrigerator compartment fan and the freezer compartment fan, and the term "food storage compartment cold air vents may encompass the refrigerator compartment cold air vents and the freezer compartment cold air vents.

The doors 1311, 1312, 1321, and 1322 are connected to the main refrigerator body 1100, and form the exterior of the front of the refrigerator 1000. The doors 1311, 1312, 1321, and 1322 are configured to open or close front openings of the main refrigerator body 1100. The doors 1311, 1312, 1321, and 1322 may be classified as swing doors or drawer-type doors. The swing doors are installed to swing on the main refrigerator body 1100, and the drawer-type doors are slidably connected to the main refrigerator body 1100.

The doors 1311, 1312, 1321, and 1322 may be classified based on installation position. Doors that open or close the refrigerator compartment 1210 may be classified as refrigerator compartment doors 1311 and 1312, and doors that open or close the freezer compartment 1220 may be classified as freezer compartment doors 1321 and 1322. Also, the doors 1311, 1312, 1321, and 1322 may be classified as a left refrigerator compartment door 1311, a right refrigerator compartment door 1312, a left freezer compartment door 1321, and a right freezer compartment door 1322, respectively, depending on whether they are installed on the left or right side.

The doors 1311, 1312, 1321, and 1322 have door liners 1311*a*, 1312*a*, 1321*a* and 1322*a* on the inside, and gaskets 1311*b*, 1312*b*, 1321*b* and 1322*b* for preventing leakage of cool air are installed around the perimeters of the door liners 1311*a*, 1312*a*, 1321*a* and 1322*a*. The door liners 1311*a*, 1312*a*, 1321*a* and 1322*a*, along with baskets 1540 to be described later, form a storage space for food. The gaskets 1311*b*, 1312*b*, 1321*b* and 1322*b* are pressed tightly against the front edges of the main refrigerator body 1100 to seal the food storage compartment 1200.

FIG. 1 illustrates swing doors 1311, 1312, 1321, and 1322 which are installed to swing on the main refrigerator body 1100. The refrigerator 1000 has hinges 1411, 1412, 1421, 1422, 1431, and 1432 for allowing the swinging of the doors 1311, 1312, 1321, and 1322.

The hinges 1411, 1412, 1421, 1422, 1431, and 1432 are classified as upper hinges 1411 and 1412, middle hinges 1421 and 1422, and lower hinges 1431 and 1432 based on installation position. Referring to FIG. 1, the upper hinges 1411 and 1412 are installed on the top of the main refrigerator body 1100. The middle hinges 1421 and 1422 are installed between the refrigerator compartment doors 1311 and the freezer compartment doors 1321 and 1322. The lower hinges 1431 and 1432 are installed under the freezer compartment doors 1321 and 1322.

The upper hinges 1411 and 1412 and the middle hinges 1421 and 1422 are connected to the top and bottom of the refrigerator compartment doors 1311 and 1312, respectively, and allow the swinging of the refrigerator compartment doors 1311 and 1312. Also, the middle hinges 1421 and 1422 and the lower hinges 1431 and 1432 are connected to the top and bottom of the freezer compartment doors 1321 and 1322, respectively, and allow the swinging of the freezer compartment doors 1321 and 1322.

The refrigerator 1000 has at least one storage unit 1500 for efficient space utilization in the food storage compartment 1200. The storage unit 1500 is a concept that includes a shelf 1510, a drawer (or tray) 1520, a pantry 1530, and baskets 1540. The shelf 1510, the drawer 1520, and the pantry 1530 may be installed in the food storage compartment 1200, and the baskets 1540 may be installed on the inside of the doors 1311, 1312, 1321, and 1322.

The shelf 1510 is shaped in the form of a plate. The shelf 1510 is installed horizontally to the food storage compartment 1200 so as to place food on top of them. A shelf holder 1146 is installed on the back wall of the food storage compartment 1200 or the covers 1140, and the shelf 1510 may be placed on the shelf holder 1146.

The drawer 1520 and the pantry 1530 each are configured to form a space separate from other parts of the food storage compartment 1200 and store food in it. The drawer 1520 and the pantry 1530 may be configured to slide, and may be inserted into or out of the food storage compartment 1200 by sliding movement.

The width of a drawer 1520 is narrower than the width of the food storage compartment 1200, and two drawers may be placed side by side on the left and right sides. By contrast, the pantry 1530 has a width corresponding to the width of the food storage compartment 1200, and is smaller in height than the drawer 1520.

Despite these differences, the drawer 1520 and the pantry 1530 cannot be seen as clearly distinct and separate, because the drawer 1520 and the pantry 1530 have something in common in that they form a space separate from other areas and are slidable. Thus, the drawer 1520 and the pantry 1530 can be reversed. Also, one of the two may be named a first drawer (or first pantry), and the other may be named a second drawer (or second pantry). The drawer 1520 or the pantry 1530 is sometimes named a tray.

In some implementations, a slidable part of the storage unit 1500 that is located on the base of the refrigerator compartment 1210 or freezer compartment 1220 is referred to as the pantry 1530, and a slidable part of the storage unit 1500 except the pantry 1530 is referred to as the drawer 1520.

The intended uses of the drawer 1520 and the pantry 1530 may be determined according to the refrigerator user's intention, and the user's intention may be determined according to the internal temperatures of the drawer 1520 and the pantry 1530. If the temperature drawer 1520 and the pantry 1530 are the same internal temperature, the drawer 1520 and the pantry 1530 do not need to be functionally separated from each other. In some implementations, if the drawer 1520 and the pantry 1530 are different internal temperatures, the drawer 1520 and the pantry 1530 each should keep different types of food in them, and the drawer 1520 and the pantry 1530 need to be functionally separated from each other.

The user of the refrigerator 1000 tends to use the refrigerator compartment 1210 more often than the freezer compartment 1220. Thus, the user of the refrigerator 1000 keeps foods in the refrigerator compartment even if they are supposed to be kept frozen in the freezer compartment 1220. However, these food items will spoil easily if the refrigerator compartment 1210 maintains a uniform temperature throughout the entire space of the refrigerator compartment 1210.

In some implementations, the internal temperature of the pantry 1530 is lower than the average temperature of the refrigerator compartment 1210 so as to keep food items that should be kept frozen from spoiling easily even when they are preserved in the refrigerator compartment 1210. For example, if the average temperature of the refrigerator compartment 1210 including the drawer 1520 is kept at about 3□, the internal temperature of the pantry 1530 may be kept at about −1□. Accordingly, the drawer 1520 is used for preserving fresh food such as vegetables, and the pantry 1530 is used for preserving food such as meat that should be kept frozen. The internal temperature of the pantry 1530, which is lower than the temperature of other areas in the refrigerator compartment 1210, may help further prevent foods from spoiling even if they are those types of food that spoil easily at usual temperatures for the refrigerator compartment 1210.

While the refrigerator compartment 1210 and the freezer compartment 1220 are spatially distinct from each other by an insulation barrier 1230, the pantry 1530 is installed within the refrigerator compartment 1210 (or freezer compartment 1220) and therefore hardly seen as spatially distinct from other areas of the refrigerator compartment 1210. For instance, the cold air in the refrigerator compartment 1210 does not flow into the freezer compartment 1220 by natural flow, whereas the cold air in the pantry 1530 may flow into other areas of the refrigerator compartment 1210 by natural flow when pulled out by sliding it. Thus, additional components are required in order to make the internal temperature of the pantry 1530 lower than the temperatures of other areas of the refrigerator compartment 1210. The components that can keep the internal temperature of the pantry 1530 lower than the temperatures of other areas of the refrigerator compartment 1210 will be described with reference to FIG. 2 and the subsequent figures.

The baskets 1540 form barriers that keep food from falling off the doors 1311, 1312, 1321, and 1322. The door liners 1311*a*, 1312*a*, 1321*a*, and 1322*a* are located on the inside of the doors 1311, 1312, 1321, and 1322, and the baskets 1540 are attached to the door liners 1311*a*, 1312*a*, 1321*a*, and 1322*a*. The door liners 1311*a*, 1312*a*, 1321*a*, and 1322*a* form a base and inside walls for storing food, and the baskets 1540 form outside walls.

Figure 2:
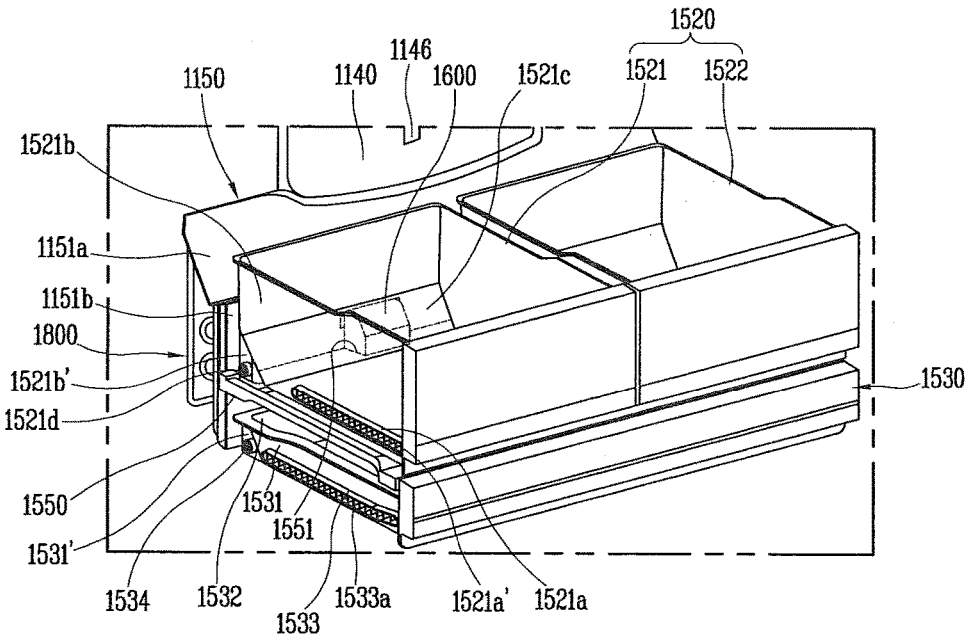
FIGS. 2 and 3 are diagrams illustrating an example interior of a refrigerator compartment.
Figure 3:
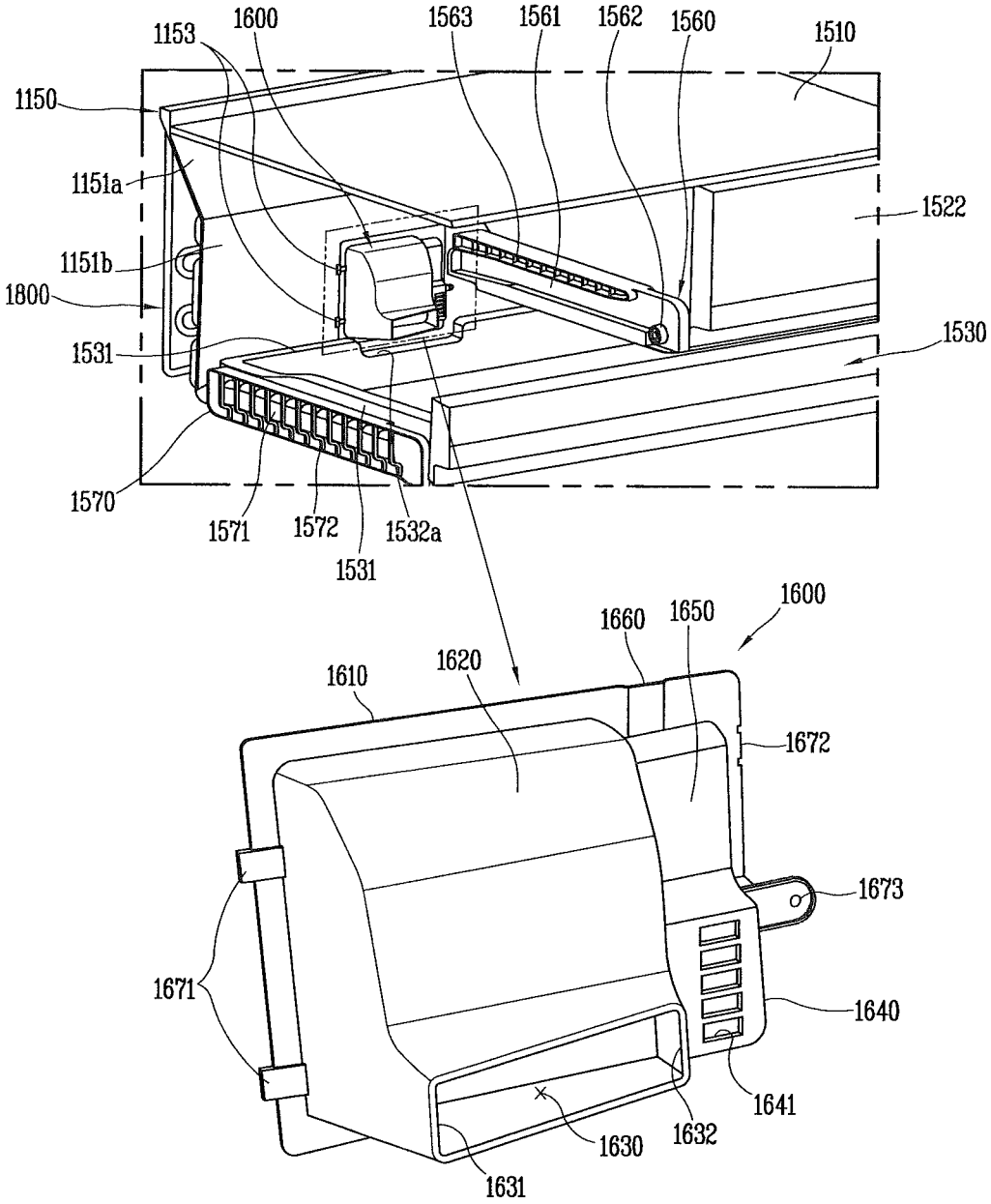

FIGS. 2 and 3 illustrate an example interior (portion A) of a refrigerator compartment. For example, the refrigerator compartment in FIGS. 2 and 3 can be the refrigerator compartment 1210 in FIG. 1. In FIG. 3, the left drawer 1521 is pulled out.

1. Covers

The covers 1140 and 1150 include a first cover 1140 and a second cover 1150. The first cover 1140 has been described above with reference to FIG. 1.

The second cover 1150 is located under the first cover 1140. The second cover 1150 is attached to the back wall of the refrigerator compartment. An evaporator 1800 is installed at the back of the second cover 1150, and the second cover 1150 blocks the evaporator 1800. The second cover 1150 spatially divides the space where the evaporator 1800 is installed and the refrigerator compartment.

The second cover 1150 has a first portion 1151*a* and a second portion 1151*b*.

The first portion 1151*a* extends in a direction in which it gets farther from the back wall of the refrigerator compartment. The first portion 1151*a* may slope down from the back wall, as shown in FIGS. 2 and 3. The first portion 1151*a* may be attached to the first cover 1140, partially corresponding to the lower end of the first cover 1140.

The second portion 1151*b* extends vertically from the lower end of the first portion 1151*a* to the base of the refrigerator compartment. The second portion 1151*b* is positioned to face the drawer 1520 and the pantry 1530. The first portion 1151*a* and the second portion 1151*b* allow for making room for installing the evaporator 1800 between the back wall of the refrigerator compartment and the second cover 1150.

2. Storage Unit (1) Pantry

The pantry 1530 is located on the base of the refrigerator compartment (or freezer compartment). The pantry 1530 has a width corresponding to the width of the refrigerator compartment.

The pantry 1530 may be inserted into or out of the refrigerator compartment by sliding movement. Referring to FIG. 2, for the sliding movement of the pantry 1530, a sliding portion 1533 and a roller 1534 are provided on both sidewalls 1531 of the pantry 1530.

The sliding portion 1533 protrudes towards the sidewalls of the refrigerator compartment from the two sidewalls 1531 of the pantry 1530, and extends in the sliding direction of the pantry 1530. The sliding direction of the pantry 1530 denotes the direction in which the pantry 1430 is inserted into or pulled out of the refrigerator compartment.

The sliding portion 1533 may be formed integral with the sidewalls 1531 and back wall 1532 of the pantry 1530 by injection molding. The sliding portion 1533 may have a deformation preventing portion 1533*a* to prevent deformation of the sliding portion 1533 that might occur after the injection molding. A plurality of deformation preventing portions 1533*a* may be provided and spaced at intervals. The deformation preventing portion 1533*a* may extend vertically and connect to the upper and lower edges of the sliding portion 1533.

The roller 1534 is installed at the rearmost part of the sidewalls 1531 of the pantry 1530. A projecting portion 1531' may be formed at the rearmost part of the left and right sidewalls 1531 of the pantry 1530. The projecting portion 1531' may be understood as protruding from the back wall 1532. The roller 1534 may be installed at the projecting portion 1531'.

The roller 1534 may be spaced apart from the sliding portion 1533. The roller 1534 is rotatable on the axis of rotation. A sliding projection, instead of the roller 1534, may be formed depending on the type of refrigerator. The sliding projection protrudes towards the sidewalls of the refrigerator compartment from the two sidewalls 1531 of the pantry 1530.

Referring to FIG. 3, a sliding rail 1570 for establishing a sliding path for the pantry 1530 is installed on the two sidewalls of the refrigerator compartment. FIG. 3 illustrates the rear of the sliding rail 1570. The sliding rail 1570 has a rail portion 1571 and a deformation preventing portion 1572.

The rail portion 1572 is configured to receive the roller 1534 and sliding portion 1533 of the pantry 1530. The rail portion 1571 extends in the sliding direction of the pantry 1530.

A plurality of deformation preventing portions 1572 may be provided and spaced at intervals. The deformation preventing portion 1572 may extend vertically and connect to the upper and lower edges of the sliding rail 1570. The deformation preventing portion 1572 of the sliding rail 1570, like the deformation preventing portion 1533*a* of the pantry 1530, is a component for preventing deformation of the sliding rail 1570 after injection molding.

Although not shown in FIG. 3, the sliding rail 1570 may have a roller at the entrance of the rail portion 1571, and the roller may rotate on the axis of rotation.

The sliding portion 1533 and roller 1534 of the pantry 1530 are inserted into the rail portion 1571. The roller 1534 rotates within the rail portion 1571, and the sliding portion 1533 slides along the rail portion 1571. In this way, the sliding movement of the pantry 1530 may be achieved.

The sidewalls 1531 of the pantry 1530 are spaced apart from the sidewalls of the refrigerator compartment in order to make room for the sliding portion 1533 and the sliding rail 1570, and the back wall 1532 of the pantry 1530 is spaced apart from the second cover 1150 in order to make room for air intakes 1152*a* and 1152*b* (see FIGS. 4 to 8). The cold air in the pantry 1530 might escape out of the pantry 1530 through the gaps between the pantry 1530 and the refrigerator compartment and second cover 1150.

To prevent cold air from escaping, the sidewalls 1531 of the pantry 1530 may be curved and protrude towards the sidewalls of the refrigerator compartment, and the back wall 1532 of the pantry 1530 may be curved and protrude towards the second cover 1150. The curved and protruding sidewalls 1531 and back wall 1532 of the pantry 1530 may block the gaps and keep cold air from escaping.

The back wall 1532 of the pantry 1530 is positioned to face the second cover 1150. Referring to FIG. 3, the back wall 1532 may include a dented portion. This dented portion is illustrated as a cold air vent area 1532*a*. The cold air vent area 1532*a* of the back wall 1532 may be set lower than other portions of the back wall 1532 and be configured to accept the duct structure 1600. A cold air vent 1630 of the duct structure 1600 is located in the cold air vent area 1532*a* which protrudes from a base portion 1610 and is provided at the back wall 1532.

(2) Drawer

The drawer 1520 is located above the pantry 1530. The drawer 1520 includes a left drawer 1521 and a left drawer 1522, and the left drawer 1521 and the right drawer 1522 may be placed side by side on the left and right sides. The width of the left drawer 1521 and the right drawer 1522 is narrower than the width of the refrigerator compartment.

The drawer 1520 is configured to be inserted into or pulled out of the refrigerator compartment by sliding movement. Referring to FIG. 2, the left drawer 1521, like the pantry 1530, has a sliding portion 1521*a* and a roller 1521*d* for sliding movement. A sliding structure of the left drawer 1521 to be described below also applies to the right drawer 1522.

The sliding portion 1521*a* protrudes from the two sidewalls 1521*b* of the left drawer 1521, and extends in the sliding direction of the left drawer 1521. The sliding direction of the left drawer 1520 denotes the direction in which the left drawer 1521 is inserted into or pulled out of the refrigerator compartment.

The sliding portion 1521*a* may be formed integral with the sidewalls 1521*b* and back wall 1521*c* of the left drawer 1521 by injection molding. The sliding portion 1521*a* may have a deformation preventing portion 1521*a*' to prevent deformation of the sliding portion 1521*a* that might occur after the injection molding. A plurality of deformation preventing portions 1521*a*' may be provided and spaced at intervals. The deformation preventing portion 1521*a*' may extend vertically and connect to the upper and lower edges around the deformation preventing portion 1521*a*'.

The roller 1521*d* is installed at the rearmost part of the sidewalls 1521*b* of the drawer 1520. A projecting portion 1521*b*' may be formed at the rearmost part of the left and right sidewalls 1521*b* of the drawer 1520. The projecting portion 1521*b*' may be understood as protruding from a sloping portion of the back wall 1521*c*. The roller 1521*d* may be installed at the projecting portion 1521*b*'. The roller 1521*d* may be spaced apart from the sliding portion 1521*a*. The roller 1521*d* is rotatable on the axis of rotation. A sliding projection, instead of the roller 1521*d*, may be formed depending on the type of refrigerator. The sliding projection protrudes from the sidewalls 1521*b* of the drawer 1520.

A sliding rail 1560 for establishing a sliding path for the drawer 1520 is installed on and between the two sidewalls of the refrigerator compartment. Although the sliding rail for sliding the drawer 1520 is not revealed in FIG. 2, FIG. 3 illustrates the sliding rail 1560 installed between the left drawer 1521 and the right drawer 1522. The sliding rail installed on the two sidewalls of the refrigerator compartment has a substantially similar structure to the sliding rail 1560 between the left drawer 1521 and the right drawer 1522.

The sliding rail 1560 between the left drawer 1521 and the right drawer 1522 is installed on the second cover 1150, and protrudes towards the front of the refrigerator from the second cover 1150. The sliding rail 1560 between the left drawer 1521 and the right drawer 1522 may be supported by a partition 1550 between the drawer 1520 and the pantry 1530.

The sliding rail 1560 has a rail portion 1561, a roller 1562, and a deformation preventing portion 1563.

The rail portion 1561 is configured to receive the roller 1521*d* and sliding portion 1521*a* of the drawer 1520. The rail portion 1561 extends in the sliding direction of the drawer 1520.

The roller 1562 is installed at the entrance of the rail portion 1561, and rotates on the axis of rotation. The sliding portion 1521*a* of the drawer 1520 may be placed on the roller 1562 of the sliding rail 1560 and slide on it.

A plurality of deformation preventing portions 1563 may be provided and spaced at intervals. The deformation preventing portion 1563 may extend vertically and connect to the upper and lower edges around the deformation preventing portion 1563. The deformation preventing portion 1563 of the sliding rail 1560, like the deformation preventing portion 1521*a* of the pantry 1520, is a component for preventing deformation of the sliding rail 1560 after injection molding.

The roller 1521*d* and sliding portion 1521*a* of the drawer 1520 are inserted into the rail portion 1561 of the sliding rail 1560. The roller 1521*d* rotates within the rail portion 1561, and the sliding portion 1521*a* slides along the rail portion 1561. In this way, the sliding movement of the drawer 1520 may be achieved.

A duct structure 1600 to be described later is installed behind the drawer 1520. The duct structure 1600 has a front portion 1620, and at least part of the front portion 1620 slopes or curves. The back wall 1521*c* of the drawer 1520 may slope or curve, either partially or wholly, corresponding to the front portion 1620 of the duct structure 1600. FIG. 2 illustrates the sloping back wall 1521*c* of the drawer 1520. The sloping or curving shape of the back wall 1521*c* of the drawer 1520 is for preventing interference with the duct structure 1600.

(3) Partition

The partition 1550 is installed between the drawer 1520 and the pantry 1530. The partition 1550 is shaped in the form of a plate so as to cover the top of the pantry 1530. The left and right sides of the partition 1550 may be supported by the two sidewalls of the refrigerator compartment, and the back of the partition 1550 may be supported by the second cover 1150.

A recess portion 1551 may be formed at the back of the partition 1550 so that the duct structure 1600 is located on it. The recess portion 1551 may be formed by recessing the partition 1550 into a shape corresponding to the duct structure 1600 protruding from the second cover 1150.

When the pantry 1530 is inserted into the refrigerator compartment by sliding it, the front portion of the pantry 1530 comes into close contact with the partition 1550. The front portion of the pantry 1530 refers to the portion where a handle 1535 of the pantry 1530 is formed. As the partition 1550 is in close contact with the front portion of the pantry 1530, the cold air in the pantry 1530 is kept from escaping to other areas in the refrigerator compartment.

A space defined by the partition 1550, the front portion of the pantry 1530, the base and two sidewalls of the refrigerator compartment, and the second cover 1150 may be referred to as the internal space of the pantry 1530. The internal space of the pantry 1530 may be separate from other spaces in the refrigerator compartment. Since the internal space of the pantry 1530 is separate from other spaces in the refrigerator compartment, the internal temperature of the pantry 1530 may be kept lower than the average temperature of the refrigerator compartment.

3. Duct Structure

Figure 5:
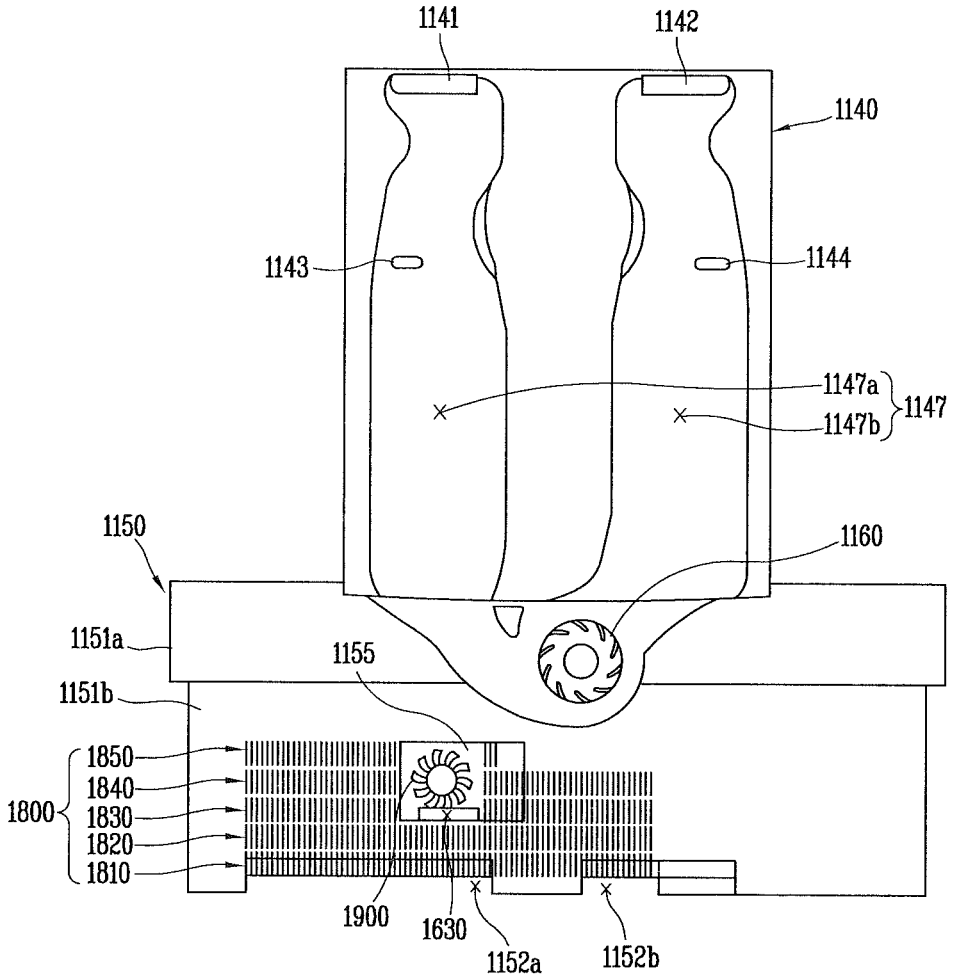
FIG. 5 is a diagram illustrating an example interior of a second cover and a duct structure of a refrigerator compartment.

The duct structure 1600 is attached to the front of the second cover 1150. Referring to FIG. 5 to be described later, a through hole 1155 is formed in the second cover 1150. The through hole 1155 is positioned to face the evaporator 1800. The duct structure 1600 is attached to the front of the second cover 1150 to cover the through hole 1155.

Referring to an enlarged view of the exterior appearance of the duct structure 1600 shown in FIG. 3, the duct structure 1600 includes a base portion 1610, a front portion 1620, and a cold air vent 1630. The duct structure 1600 additionally includes a temperature sensor receiving portion 1640, a cold air inlet/outlet 1641, a wire receiving portion 1650, a wire receiving groove 1660, and an attaching portion 1671, 1672, and 1673.

The base portion 1610 forms the perimeter of the duct structure 1600. The other components of the duct structure 1600, including the front portion 1620, the cold air vent 1630, protrude from the base portion 1610.

The base portion 1610 is attachable to the second cover 1150. The attaching portion 1671, 1672, and 1673 is provided on the base portion 1610. The attaching portion 1671, 1672, and 1673 is a concept that includes the components for attaching the duct structure 1600 to the second cover 1150. The attaching portion 1671, 1672, and 1673 includes attaching projections 1671 and 1672 and a fastener insertion part 1673.

The attaching projections 1671 and 1672 may be formed on one side or both sides of the base portion 1610. Referring to the duct structure 1600 of FIG. 3, the two attaching projections 1671 on the left side protrude out of the duct structure 1600 from the base portion 1610, and the attaching projection 1672 on the right side is formed by cutting part of the base portion 1610. The shapes and configurations of the attaching projections 1671 on the left side and the attaching projection 1672 on the right side may be reversed.

Attaching projection receiving portions 1153 are formed in the second cover 1150, and the attaching protrusion receiving portions 1153 are configured to receive the attaching projections 1671 and 1672 of the duct structure 1600. When the attaching projections 1671 and 1672 are inserted into the attaching projection receiving portions 1163, the duct structure 1600 is temporarily fixed to the second cover 1150.

The duct structure 1600 is permanently fixed by a fastener. The fastener insertion portion 1673 protrudes from the base portion 1610, and receives the fastener. When the fastener is inserted into the fastener insertion portion 1673 and fastened to the second cover 1150, the duct structure 1600 and the second cover 1150 are permanently fixed.

The duct structure 1600 includes the front portion 1620 protruding from the base portion 1610. The front portion 1620 of the duct structure 1600 is positioned to face the front of a pantry fan 1900 (see FIG. 5) to be described later. The pantry fan is installed inside the duct structure 1600. The inside of the front portion 1620 faces the pantry fan, and the outside of the front portion 1620 faces the drawer 1520 or the partition 1550. The front portion of FIG. 3 corresponds to the outside.

At least part of the front portion 1620 may slope or curve down from the pantry fan. It can be said that, since the cold air vent 1630 is formed under the front portion 1620, at least part of the front portion 1620 slopes or curves down towards the cold air vent 1630 from the pantry fan.

The front portion 1620 slopes or curves down so as to create a cold air flow space between the front portion 1620 and the pantry fan as the front portion 1620 gets farther from the pantry fan and to let cold air out to the cold air vent 1630 of the duct structure 1600 through the cold air flow space.

Referring to FIG. 5, the refrigerator compartment fan 1160 is located behind the second cover 1150, and the refrigerator compartment fan 1160 is a centrifugal fan. The centrifugal fan blows air in a circumferential direction by centrifugal force generated from inside the blades. On the contrary, the pantry fan is an axial fan, and the axial fan blows air in an axial direction. The centrifugal fan is configured to blow large volumes of air by a stronger suction force than the axial fan. Thus, cold air may be drawn in by the operation of the refrigerator compartment fan 1160, rather than being released via the cold air vent 1630, unless there is a large enough space for cold airflow between the pantry fan and the duct structure 1600.

Nevertheless, a large enough space for cold airflow may be created between the pantry fan and the duct structure 1600 since the front portion 1620 of the duct structure 1600 slopes or curves down from the pantry fan. With the front portion 1620 of the duct structure 1600 sloping or curving down, the cold airflow caused by the pantry fan may be naturally released via the cold air vent 1630 under the front portion 1620, and the structure of the front portion 1620 may help prevent reverse flow of cold air.

The sloping angle or curvature of the front portion 1620 may not be constant. For example, referring to FIG. 3, it can be seen that the sloping angle of the front portion 1620 changes at a certain point and the front portion 1620 slopes more steeply down this point. An inflection point may also exist in a case where the front portion 1620 slopes.

As explained above, the back wall 1521*c* of the drawer 1520 also slopes or curves, corresponding to the sloping or curving shape of the front portion 1620.

The cold air vent 1630 protrudes towards the pantry 1530. The cold air vent 1630 sits at a height midway between the pantry 1530 and the drawer 1520. The cold air vent area 1532*a* is formed on the back wall 1532*a* of the pantry 1530, and the cold air vent 1630 is located in the cold air vent area 1532*a*.

The perimeter 1631 and 1632 of the cold air vent 1630 protrudes from the front portion 1620 or the base portion 1610. Either the left perimeter 1631 or the right perimeter 1632 protrudes further than the other so that the cold air vent 1630 opens in an oblique direction. In this way, the cold air vent 1630 may be slanted towards the center of the pantry 1530.

The duct structure 1600 is positioned to face the evaporator 1800 to supply the cold air generated by the evaporator 1800 (see FIG. 5) directly into the pantry 1530, and the evaporator 1800 is located off-center to one side (eccentrically to one side) behind the second cover 1150. As well as the evaporator, a variety of parts for running the refrigerator, such as a printed circuit board, are installed behind the second cover 1150, which makes it difficult to locate the evaporator at the center. Also, the evaporator 1800 should be placed off-center to one side, especially in order to prevent the evaporator and the refrigerator compartment cold airflow path 1147 from interfering with each other.

The duct structure 1600, too, is located off-center to one side of the refrigerator to correspond to the position of the evaporator. Also, the duct structure 1600 should be located off-center to one side of the refrigerator compartment, especially in order to prevent the drawer 1520 from interfering with the sliding rail 1560 for sliding movement.

With the duct structure 1600 located off-center, the cold air coming from the cold air vent 1630 of the duct structure 1600 might be supplied mostly to one side, rather than uniformly throughout the inside of the pantry 1530. To solve this problem, the cold air vent 1630 of the duct structure 1600 may be slanted towards the center of the pantry 1530. Cold air may be supplied towards the center of the pantry 1530 due to the slanted shape of the cold air vent 1630, uniformly throughout the inside of the pantry 1530.

The temperature sensor receiving portion 1640 is provided on one side (right side of FIG. 3) of the cold air vent 1630. The temperature sensor receiving portion 1640 protrudes from the base portion 1610, and receives a temperature sensor in it. The temperature sensor receiving portion 1640 has the cold air inlet/outlet 1641 to allow the cold air in the pantry 1530 to flow into the temperature sensor receiving portion 1640. While the cold air vent 1630 is a component for forcing cold air out by the pantry fan 1900, the cold air inlet/outlet 1641 is a component for bringing the cold air in the pantry 1530 into contact with the temperature sensor by natural movement.

If the temperature inside the pantry 1530 rises higher than a set temperature, the evaporator and the pantry fan are run to supply cold air to the space in the pantry 1530, and therefore the temperature inside the pantry 1530 may decrease back to the set temperature. Whether to run the evaporator and the pantry fan or not is determined by the temperature inside the pantry 1530 measured by the temperature sensor.

The wire receiving portion 1650 and the wire receiving groove 1660 form a wire area that supplies the power required for running the pantry fan 1900. The power receiving portion 1650 may protrude from the base portion 1610, and be provided on one side of the front portion 1620. The wire receiving groove 1660 may be formed in an area where a wire extends out of the duct structure 1600 past the base portion 1610. Placing a wire in the wire receiving portion 1650 and the wire receiving groove 1660 may prevent wire breakage even if the duct structure 1600 is in close contact with the second cover 1150.

While the configuration of the above-explained covers 1140 and 1150, drawer 1520, pantry 1530, partition 1550, and duct structure 1600 have been described with respect to the refrigerator compartment, they may also apply to the freezer compartment.

Figure 4:
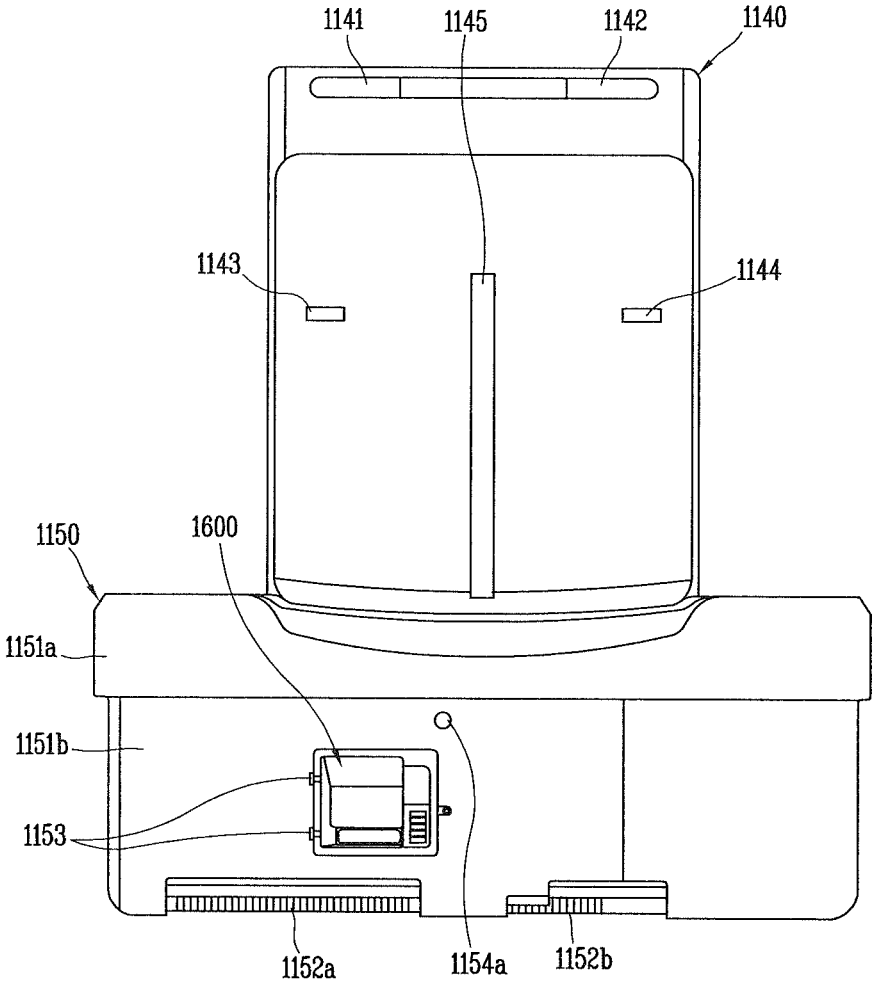
FIG. 4 is a diagram illustrating an example second cover and an example duct structure of a refrigerator compartment.

FIG. 4 illustrates an example second cover and an example duct structure of a refrigerator compartment. In FIG. 4, the storage unit of FIG. 2 is entirely removed. FIG. 5 illustrates an example interior of a second cover and a duct structure of a refrigerator compartment.

Referring to FIG. 4, the first cover 1140 includes a plurality of cold air vents 1141, 1142, 1143, and 1144 and a shelf holder receiving portion 1145. The second cover 1150 includes a fastener insertion portion 1154*a* for fixing to the back wall of the refrigerator compartment. The fastener insertion portion 1154*a* is configured to receive a fastener that is inserted into the fastener insertion portion 1154*a*, and the fastener includes a screw, for example. Air intakes 1152*a* and 1152*b* are formed below the second cover 1150, and the duct structure 1600 is attached to the front of the second cover 1150, with a height difference with the air intakes 1152*a* and 1152*b*. The air intakes 1152*a* and 1152*b* are configured to draw in air from inside the pantry 1530 to the space behind the second cover 1150.

Referring to FIG. 5, the refrigerator compartment cold airflow path 1147 is formed behind the first cover 1140, and the refrigerator compartment fan 1160 and the evaporator 1800 are installed behind the second cover 1150. The second cover 1150 is configured to block the evaporator 1800. The second cover 1150 includes a through hole 1155 that is positioned to face the evaporator 1800.

Referring to FIGS. 4 and 5, the duct structure 1600 is attached to the front of the second cover 1150 to cover the through hole 1155. The pantry fan 1900 is installed inside the duct structure 1600 and positioned to face the evaporator 1800.

The refrigerator compartment cold air vents 1141, 1142, 1143, and 1144 open towards the refrigerator compartment. While FIGS. 4 and 5 illustrate that the refrigerator compartment cold air vents 1141, 1142, 1143, and 1144 are formed in the first cover 1140, they also may be formed on the back wall of the refrigerator compartment. The refrigerator compartment cold air vents 1141, 1142, 1143, and 1144 are configured to lead to the refrigerator compartment cold airflow path 1147, and the cold air flowing through the refrigerator compartment cold airflow path 1147 may be released to the refrigerator compartment via the refrigerator compartment cold air vents 1141, 1142, 1143, and 1144.

The shelf holder receiving portion 1145 receives the shelf holder 1146 (see FIG. 1). The shelf holder receiving portion 1145 may extend vertically. The shelf holder may be installed on the shelf holder receiving portion 1145, and a plurality of shelves 1510 (see FIG. 1) may be placed on the shelf holder, with height differences between them.

The refrigerator compartment cold airflow path 1147 of FIG. 5 is configured to surround the periphery of the refrigerator compartment fan 1160. The perimeter of the refrigerator compartment fan 1160 refers to the circumference of the refrigerator compartment fan 1160. The refrigerator compartment cold airflow path 1147 extends from the perimeter of the refrigerator compartment fan 1160 and connects to the refrigerator compartment cold air vents 1141, 1142, 1143, and 1144. The refrigerator compartment cold airflow path 1147 may be divided into two segments 1147*a* and 1147*b*, as shown in FIG. 5.

The refrigerator compartment fan 1160 is installed on the back wall of the refrigerator compartment or behind the second cover 1150. The refrigerator compartment fan 1160 blows air in a circumferential direction to supply the cold air generated by heat transfer across the evaporator 1800 to the refrigerator compartment cold air vents 1141, 1142, 1143, and 1144. The circumference of the refrigerator compartment fan 1160 is surrounded by the refrigerator compartment cold airflow path 1147, so the cold air moved by the refrigerator compartment fan 1160 flows along the refrigerator compartment cold airflow path 1147.

The refrigerator compartment fan 1160 is a centrifugal fan that blows air in a circumference direction. The centrifugal fan refers to a type of fan that draws in cold air along the axis of rotation and releases it in the circumference direction. The axial direction of the refrigerator compartment fan 1160 of FIG. 5 corresponds to the direction facing the front of the refrigerator compartment fan 1160.

The warm air generated by heat transfer with the food in the refrigerator compartment gets cold by heat transfer across the evaporator 1800. The cold air is drawn in in the axial direction of the centrifugal fan, released in the circumferential direction, and supplied back to the refrigerator compartment sequentially via the refrigerator compartment cold airflow path 1147 and the refrigerator compartment cold air vents 1141, 1142, 1143, and 1144.

The pantry fan 1900 is located outside the refrigerator compartment cold airflow path 1147 so as to supply cold air to the pantry 1530 through a cold airflow path, which is separate from the refrigerator compartment cold airflow path 1147. That is, dual cold airflow paths are provided. One of the dual cold airflow paths is the refrigerator compartment cold airflow path 1147 to which cold air is supplied from the refrigerator compartment fan 1160, and the other is the cold airflow path that supplies cold air directly to the pantry 1530 from the evaporator 1800 through the pantry fan 1900.

In some implementations, the cold airflow path for supplying cold air to the pantry 1530 is formed integral with the refrigerator compartment cold airflow path 1147 to supply cold air to the pantry 1530 from the refrigerator compartment fan 1160. For example, the refrigerator compartment cold airflow path 1147 may include an additional segment that opens towards the pantry 1530. Because the function of supplying cold air to the refrigerator compartment is determined by a combination of the refrigerator compartment fan 1160 and the refrigerator compartment cold airflow path 1147, the additional segment may cause a loss of cold air flow.

The pantry fan 1900 is an axial fan that blows air in an axial direction. The axial fan is a type of fan that has a plurality of blades along the circumference of a rotating body and draws in air from behind along the shaft and releases it to the front. It is preferable that the refrigerator compartment fan 1160 blows air in the circumferential direction since the refrigerator compartment cold air vents 1141, 1142, 1143, and 1144 are far from the refrigerator compartment fan 1160. On the contrary, it is preferable that the pantry fan blows air in the axial direction since the pantry fan 1900 is positioned to face the evaporator 1800 and the cold air vent 1630 of the duct structure 1600 is located close to the pantry fan 1900.

The evaporator 1800 include a plurality of rows that are formed by a stack of refrigerant pipes. Referring to FIG. 5, the evaporator 1800 may be formed in five rows, for example. The plurality of rows may include a first row 1810, a second row 1820, a third row 1830, a fourth row 1840, and a fifth row 1850, from bottom to top, according to the order of stacking them. The plurality of rows may be divided into upper rows and lower rows according to height. For example, with respect to the boundary between the second row 1820 and the third row 1830, the first row 1810 and the second row 1820 are classified as the lower rows, and the third to fifth rows 1830 to 1850 may be classified as the upper rows.

The air intakes 1152*a* and 1152*b* formed in the second cover 1150 are formed at a height corresponding to the lower rows. Referring to FIG. 5, it can be seen that the air intakes 1152*a* and 1152*b* are formed at a height corresponding to the first row 1810. On the contrary, the through hole 1155 of the second cover 1150, the pantry fan 1900, and the duct structure 1600 is formed at a height corresponding to the upper rows, with height differences between them. Referring to FIG. 5, it can be seen that the pantry fan 1900 is formed at a height corresponding to the third to fifth rows 1830 to 1850.

Since the through hole 1155 and the duct structure 1600 are spaced apart from the air intakes 1152*a* and 1152*b*, the air flowing into the evaporator 1800 via the air intakes 1152*a* and 1152*b* may transfer heat across the evaporator 1800 for a sufficient amount of time and may get cold enough. In some implementations, if the through hole 1155 and the duct structure 1600 are located close to the air intakes 1152*a* and 1152*b*, rather than being spaced apart from them, the air flowing into the air intakes 1152*a* and 1152*b* may flow back to the pantry without transferring heat across the evaporator 1800 for a sufficient amount of time.

Figure 6:
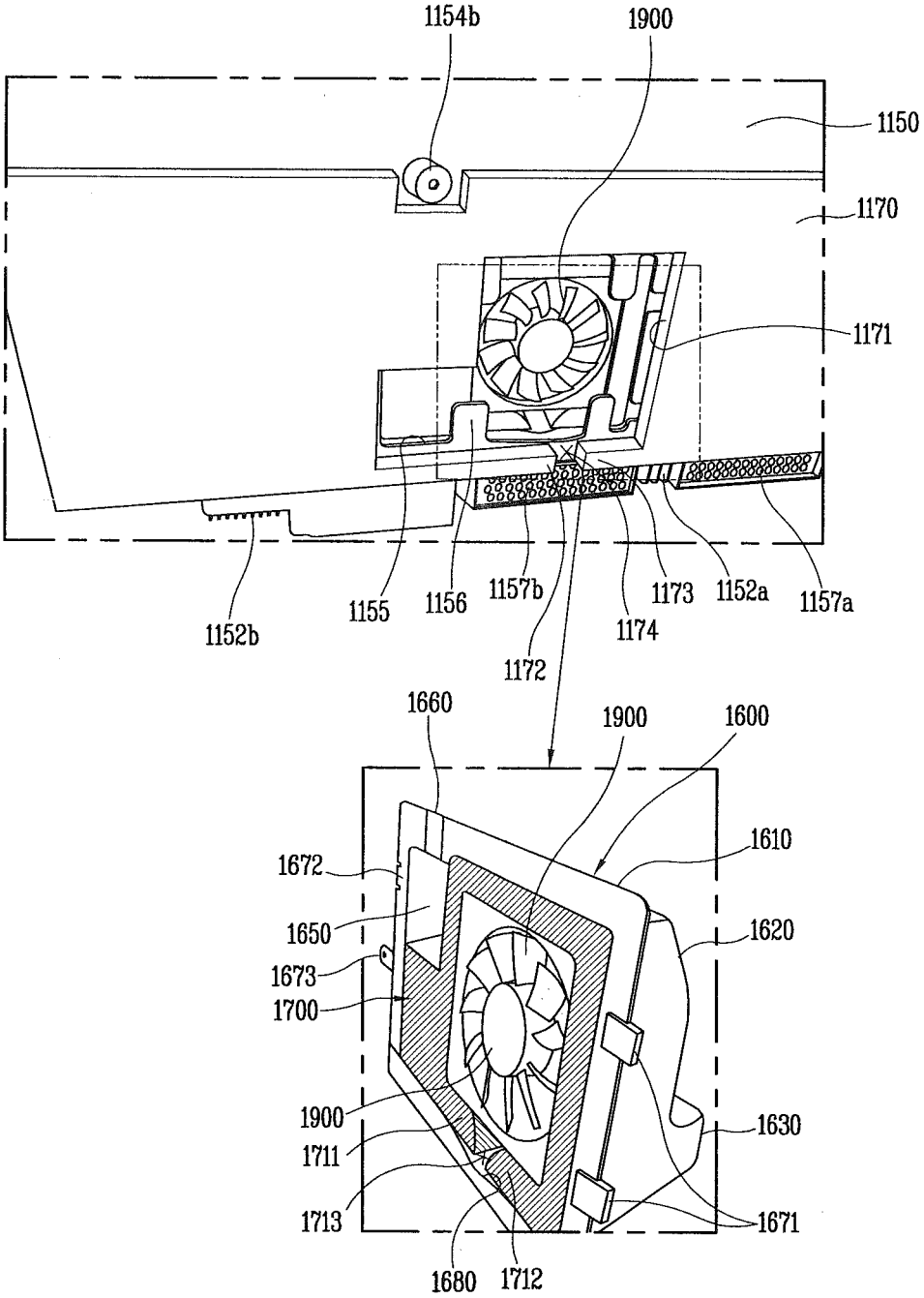
FIG. 6 is a diagram illustrating an example second cover and an example duct structure.

FIG. 6 illustrates an example second cover and an example duct structure. In FIG. 6, the rear of the second cover 1150 is illustrated when viewed from the position of the evaporator 1800 (see FIG. 8).

A boss portion 1154*b* is formed at the rear of the second cover 1150. The boss portion 1154*b* is formed on the opposite side of the fastener insertion portion 1154*a* of FIG. 4. The boss portion 1154*b* is configured to surround a fastener that is inserted into the fastener insertion portion 1154*a*.

The refrigerator 1000 includes cover insulation 1170 installed at the rear of the second cover 1150. The cover insulation 1170 has an opening 1171 corresponding to the through hole 1155, and covers the rear of the second cover 1150 except the through hole 1155. The base portion 1610 of the duct structure 1600, the pantry fan 1900, and duct insulation 1700 are exposed through the opening 1171.

The cover insulation 1170 includes a slot between two parts 1172 and 1173 of the cover insulation 1170 that are spaced apart from each other under the opening 1171. The slot allows to flow any liquid, e.g., water, through a drainage passage 1174. For example, the water condensed inside the duct structure 1600 may be drained through the drainage passage 1174 of the cover insulation 1170.

In some implementations, the refrigerator may include a drainage area to collect water drained from the drainage passage 1174. In some other implementations, the drainage area can include a slope. The slope of the drainage area can drain water collected in the drainage area.

The second cover 1150 may have a plurality of ridges 1156 protruding towards the through hole 1155 to support the duct structure 1600. The ridges 1156 are spaced apart from one another, and FIG. 6 illustrates that two ridges 1156 are formed at the top of the through hole 1155 and two ridges 1156 are formed at the bottom of the through hole 1155. Preferably, the ridges 1156 are positioned further outward than the circumference of the pantry fan 1900 so that they do not block the air generated by the pantry fan 1900.

The air intakes 1152*a* and 1152*b* are formed at the bottom of the second cover 1150. A plurality of air intakes 1152*a* and 1152*b* may be provided, and filters 11571 and 1157*b* may be installed at the exit of the air intakes 1152*a* and 1152*b* facing towards the evaporator 1800. The filters 11571 and 1157*b* may be configured to prevent impurities from entering the evaporator via the air intakes 1152*a* and 1152*b* or to remove smells.

As explained above, the duct structure 1600 includes attaching projections 1671 and 1672 and a fastener insertion portion 1673. Thus, the duct structure 1600 may be attached to the front of the second cover 1150. However, the duct structure 1600 may fall out onto the evaporator 1800 through the through hole 1155 in the second cover 1150. The ridges 1156 may support the base portion 1610 of the duct structure 1600, and the ridges 1156 may prevent the duct structure 1600 from being arbitrarily removed from the second cover 1150.

The duct insulation 1700 is located between the pantry fan 1900 and the duct structure 1600. The duct insulation 1700 is configured to surround the edge of the pantry fan 1900, and the edge of the duct insulation 1700 is surrounded by the duct structure 1600. The duct insulation 1700 may fix the pantry fan 1900 in place since it surrounds the pantry fan 1900.

In some implementations, the duct insulation 1700 is optional and that the pantry fan 1900 may be attached directly to the inside of the duct structure 1600 without the duct insulation 1700.

In some implementations, the duct insulation 1700 can have a hole 1730 (see FIG. 8) corresponding to the cold air vent 1630 of the duct structure 1600 in order to not block the flow of cold air generated by the pantry fan 1900.

The duct insulation 1700 is configured to block most of the back of the duct structure 1600, but does not block the wire receiving portion 1650 in order to place a wire in it. Also, the duct insulation 1700 may include a slot between two parts 1711 and 1712 of the duct insulation 1700 that are spaced apart from each other. The slot is located between the lower end of the pantry fan 1900 and the base of the duct structure 1600. The slot allows any liquid, e.g., water, to flow through a drainage passage 1713.

The base of the duct structure 1600 has a drainage area 1680 that is partially set lower than other areas to collect water in it. The drainage area 1680 slopes towards the through hole 1155 to drain collected water. The drainage passage 1713 of the duct insulation 1700, the drainage area 1680 of the duct structure 1600, and the drainage passage 1174 of the cover insulation 1170 are sequentially positioned to form one drainage passage.

Figure 7:
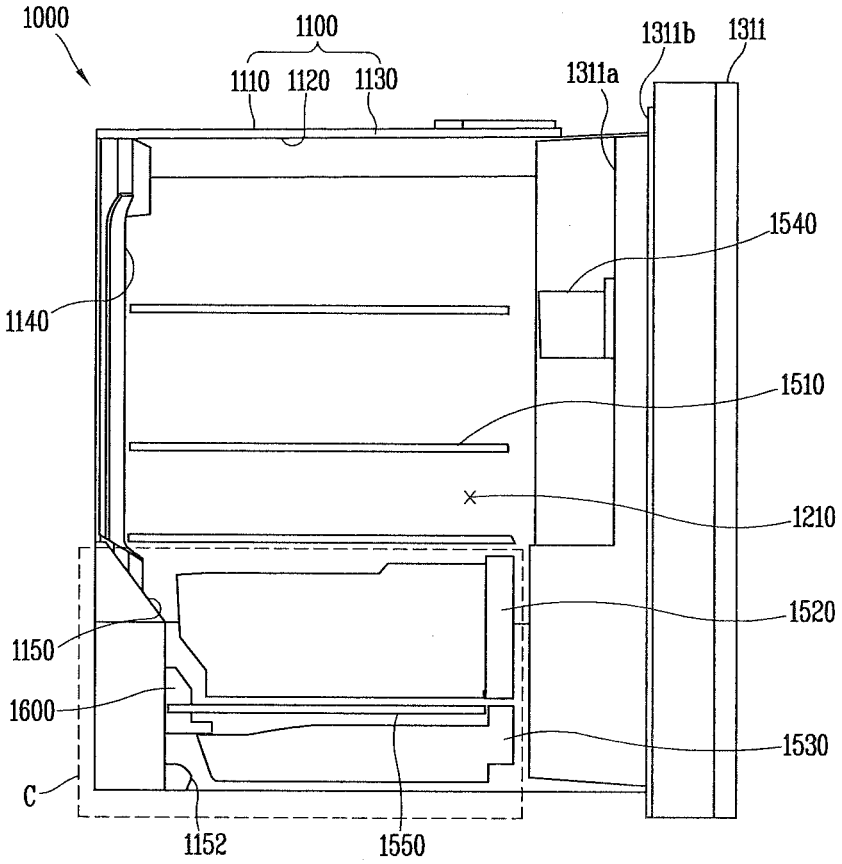
FIG. 7 is a diagram illustrating an example interior of a refrigerator compartment.
Figure 8:
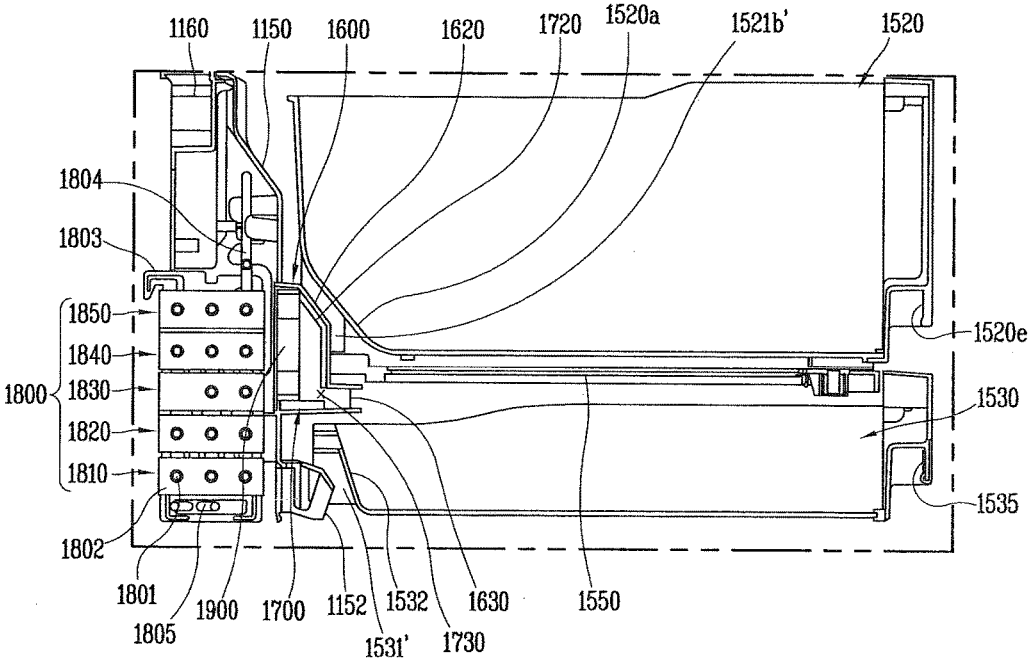
FIG. 8 is a diagram illustrating an example refrigerator compartment.

FIG. 7 illustrates an example interior of a refrigerator compartment. For example, the example interior of a refrigerator compartment in FIG. 7 can be a cross-sectional view taken along the line B-B of the refrigerator compartment 1210 of FIG. 1 when viewed from one side. FIG. 8 illustrates an example refrigerator compartment. For example, the refrigerator compartment (portion C) of FIG. 7 can be the example refrigerator compartment in FIG. 8.

The insulation 1130 fills in the space between the outer casing 1110 and the inner casing 1120. The door is configured to open or close the front openings of the main refrigerator body 1100. A configuration in which the door liner 1311*a* and the gasket 1311*b* are provided on the door 1311, a configuration in which the basket 1540 is attached to the door 1311, and a configuration in which the shelf 1510 is installed to the refrigerator compartment 1210 have been described with reference to FIG. 1. Also, a configuration in which the first cover 1140 and the second cover 1150 are installed to the back wall of the refrigerator compartment 1210 has been described above with reference to FIG. 2.

The pantry 1530 is located at the base of the refrigerator compartment 1210, and the drawer 1520 is installed above the pantry 1530. The partition 1550 is installed between the pantry 1530 and the drawer 1520, and the partition 1550 forms a boundary between the drawer 1520 and the pantry 1530. When the pantry 1530 is closed, the partition 1550 comes into close contact with the front portion of the pantry 1530. The front portion of the pantry 1530 refers to the portion where the handle 1535 of the pantry 1530 is formed. A handle 1520*e* of the drawer 1520 and the handle 1535 of the pantry 1530 are installed in the direction facing the door.

The second cover 1150 is installed behind the drawer 1520 and the pantry 1530. The air intake 1152*a* and 1152*b* are formed below the second cover 1150. The perimeter of the air intakes 1152*a* and 1152*b* may protrude towards the bottom of the pantry 1530. The duct structure 1600 is set higher than the air intakes 1152*a* and 1152*b*, with a height difference with the air intakes 1152*a* and 1152*b*.

The duct insulation 1700 has a front portion 1620 facing the front of the pantry fan 1900. At least part of the front portion 1620 may slope or curve down from the pantry fan 1900.

At least part of the front portion 1620 may slope or curve down from the pantry fan 1900. It can be said that, since the hole 1730 corresponding to the cold air vent 1630 is formed under the front portion 1620, at least part of the front portion 1620 slopes or curves down towards the hole 1730 from the pantry fan 1900.

The sloping angle or curvature of the front portion 1620 may not be constant. For example, referring to FIG. 8, it can be seen that the sloping angle of the front portion 1620 changes at a certain point and the front portion 1620 slopes more steeply down this point. An inflection point may also exist in a case where the front portion 1620 slopes.

As explained above, the duct structure 1600 slopes or curves. The duct insulation 1700 also slopes or curves for the same reason as the duct structure 1600. In a refrigerator without the duct insulation 1700, the duct insulation 1700 is optional, so it is necessary for the front portion 1620 of the duct structure 1600 to slope or curve 1700. In some implementations, in a refrigerator with the duct insulation 1700, it is not always necessary for the duct structure 1600 to slope or curve, but only the duct insulation 1700 may slope or curve.

The back wall 1521*b*' of the drawer 1520 may slope or curve, corresponding to the front portion 1620 of the duct structure 1600, and is spaced apart from the duct structure 1600. Similarly, the back wall 1531 of the pantry 1530 is spaced apart from the air intakes 1152*a* and 1152*b*.

The evaporator 1800 include a plurality of rows that are formed by a stack of refrigerant pipes 1801. A fin 1802 is attached to each refrigerant pipe to increase the heat transfer area. The air intakes 1152*a* and 1152*b* are placed corresponding to the lower row 1810, and the duct structure 1600 and the pantry fan 1900 are placed corresponding to the upper rows 1830, 1840, and 1850. The evaporator 1800 is connected to a number of refrigerant pipes 1803, 1804, and 1805.

The duct structure 1600 protrudes to the space between the pantry 1530 and the partition 1550. Thus, the air cooled across the evaporator 1800 may be supplied directly to the pantry 1530 via the cold air vent 1630, and the internal temperature of the pantry 1530 may be kept lower than the average temperature of the refrigerator compartment 1210.

The refrigerator compartment fan 1160 may be installed higher than the evaporator 1800. Cold air is supplied to the refrigerator compartment 1210 by the refrigerator compartment fan 1160. The refrigerant compartment cold airflow path 1147 (see FIG. 5) and the cold airflow path for supplying cold air to the pantry 1530 are in a dual configuration. The cold airflow path for supplying cold air to the pantry 1530 refers to a path formed by the duct structure 1600.

Figure 9:
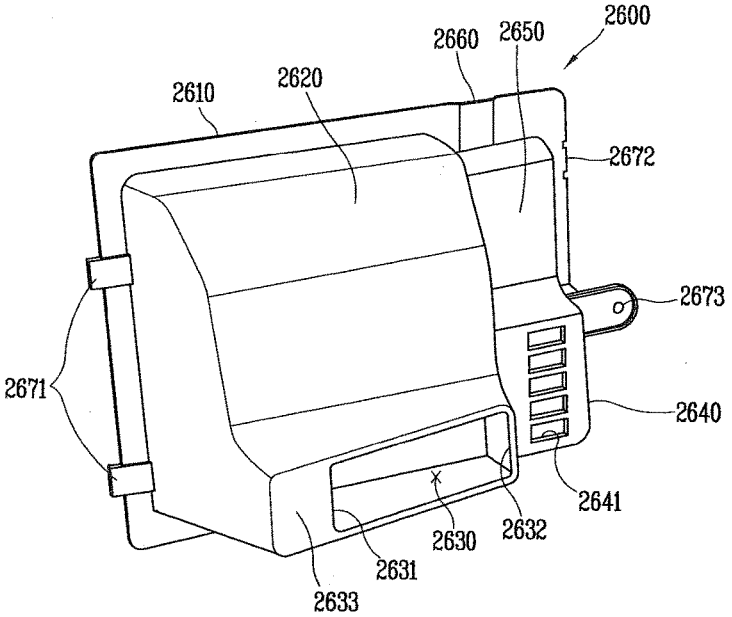
FIG. 9 is a diagram illustrating an example duct structure.

FIG. 9 illustrates an example duct structure. The components of the duct structure 2600 of FIG. 9 are identical to those of the duct structure 1600 of FIGS. 3 to 6, except that the duct structure 2600 includes a blocking portion 2633. The duct structure 2600 includes a base portion 2610, a front portion 2620, an cold air vent 2630, a temperature sensor receiving portion 2640, a cold air inlet/outlet 2641, a wire receiving portion 2650, a wire receiving groove 2660, attaching portions 2671 and 2672, a fastener insertion portion 2673, and a drainage area. A description of these components will be substituted with the description of FIGS. 3 to 6.

The blocking portion 2633 is configured to block at least part of the cold air vent 2630. A part of the cold air vent 2630 blocked by the blocking portion 2633 corresponds to either one of the left perimeter 2631 and right perimeter 2632 of the cold air vent 2630 that protrudes further than the other. For example, the left perimeter 2631 and the right perimeter 2632 are formed around the cold air vent 2630 shown in FIG. 9, and the left perimeter 2631 protrudes further than the right perimeter 2632. Accordingly, the cold air vent 2630 opens in an oblique direction.

The part of the cold air vent 2630 corresponding to either one of the left perimeter 2631 and right perimeter 2632 that protrudes further than the other may be partially blocked by the blocking portion 2633. For example, referring to FIG. 9, the blocking portion 2633 may be configured to block a part of the cold air vent 2630 corresponding to the left perimeter 2631.

The blocking portion 2633 is formed in order to release cold air towards the center of the pantry 2530 from the duct structure 2600 that is placed off-center to one side of the center of the pantry 2530. Since the left side of the cold air vent 2630 is blocked by the blocking portion 2633, cold air may be released through the center or right side of the cold air vent 2630, and it is expected that cold air will be naturally released towards the center of the pantry 2530.

In some implementations, the descriptions described above with reference to the refrigerator compartment 1210 (see FIG. 1) can be applied to the freezer compartment 1220 (see FIG. 1). In this example, the components of the freezer compartment may be named a freezing compartment cold airflow path, a freezing compartment fan, and freezing compartment cold air vents, corresponding to the refrigerator compartment cold airflow path, refrigerator compartment fan, refrigerator compartment cold air vents. Also, the term "food storage compartment airflow path" may encompass the refrigerator compartment airflow path and the freezer compartment airflow path, the term "food storage compartment fan" may encompass the refrigerator compartment fan and the freezer compartment fan, and the term "food storage compartment cold air vents may encompass the refrigerator compartment cold air vents and the freezer compartment cold air vents.

What is claimed is:

1. A refrigerator comprising:

a storage compartment;

a pantry that is located in the storage compartment and that includes an interior area;

an evaporator that is coupled to the storage compartment and that is configured to cool air;

a cover that is coupled to the evaporator, that is configured to isolate the interior of the pantry from the evaporator, and that includes a through hole, the through hole being configured to enable flow of air from the evaporator to the interior area of the pantry;

a duct structure that is coupled to a first surface of the cover to protrude toward the storage compartment, that is configured to cover the through hole, and that includes a cold air vent protruding toward the interior area of the pantry; and a pantry fan that is coupled to the duct structure and that is configured to provide air cooled by the evaporator to the interior area of pantry through the cold air vent of the duct structure, wherein the pantry fan and the duct structure are installed at a height facing the evaporator to supply, to the pantry, cool air generated by the evaporator.

2. The refrigerator of claim 1, wherein the duct structure includes:

a perimeter portion that surrounds the cold air vent and that includes a first perimeter portion and a second perimeter portion, and wherein the first perimeter portion protrudes toward the interior area of the pantry more than the second perimeter portion.

3. The refrigerator of claim 2, wherein the cold air vent includes:

a first cold air vent that corresponds to the first perimeter portion, and a second cold air vent that corresponds to the second perimeter portion, and wherein either the first cold air vent or the second cold air vent is at least partly blocked.

4. The refrigerator of claim 1, wherein the duct structure includes:

a first portion that faces the pantry fan, that is configured to guide air provided from the pantry fan to the cold air vent, and that includes a slope or a curve.

5. The refrigerator of claim 4, further comprising:

a drawer that is located at a first side of the pantry and that includes a first surface facing the duct structure, the first surface including a slope or a curve, wherein the cold air vent is located between the pantry and the drawer.

6. The refrigerator of claim 1, wherein the pantry includes:

a first surface that faces the cover and that includes a dented portion, the dented portion being configured to accept the duct structure.

7. The refrigerator of claim 1, further comprising:

a duct insulation part that is coupled between the pantry fan and the duct structure, that is configured to at least partly surround a perimeter of the pantry fan, and that includes a hole, the hole being configured to enable flow of air from the evaporator to the cold air vent.

8. The refrigerator of claim 7, wherein the duct insulation part includes:

a first portion that faces the pantry fan and that includes a slope or a curve.

9. The refrigerator of claim 7, wherein the duct insulation part includes:

a slot that is located in a bottom area of the duct insulation part and that is configured to drain water through a drainage passage.

10. The refrigerator of claim 9, wherein the duct structure includes:

a drainage area that is located in a bottom area of the duct structure and that is configured to collect water drained through the drainage passage.

11. The refrigerator of claim 10, wherein the drainage area includes:

a slope that slopes toward the through hole and that is configured to drain water collected in the drainage area.

12. The refrigerator of claim 1, further comprising:

a cover insulation part that is coupled to a second surface of the cover, the cover insulation part including:

an opening that is located in an area of the cover insulation part corresponding to the through hole of the cover, and a slot that is located in a bottom area of the cover insulation part and that is configured to drain water through a drainage passage.

13. The refrigerator of claim 12, further comprising:

a drainage area that is located below the cover insulation part and that is configured to collect water drained through the drainage passage.

14. The refrigerator of claim 13, wherein the drainage area includes:

a slope that is configured to drain the water collected in the drainage area.

15. The refrigerator of claim 1, wherein the duct structure includes:

a drainage area that is located in a bottom area of the duct structure and that is configured to collect water.

16. The refrigerator of claim 15, wherein the drainage area includes:

a slope that slopes toward the through hole and that is configured to drain water collected in the drainage area.

17. The refrigerator of claim 1, wherein the pantry fan is an axial fan that is configured to move air in an axial direction.

18. The refrigerator of claim 1, further comprising:

a storage compartment cold air vent that is located on a surface of the storage compartment or on a surface of the cover;

a storage compartment fan that is coupled to the surface of the storage compartment or to the surface of the cover and that is configured to move air cooled by the evaporator in a circumferential direction, through the evaporator, to the storage compartment cold air vent;

a storage compartment cold airflow path that surrounds a perimeter of the storage compartment fan, and that extends from the perimeter of the storage compartment fan to the storage compartment cold air vent; and a first pantry fan that is located outside the storage compartment cold airflow path and that is configured to provide air cooled by the evaporator to the pantry through a cold airflow path, the cold airflow path being separate from the storage compartment cold airflow path.

19. The refrigerator of claim 1, wherein the evaporator includes:

a plurality of refrigerant pipes, each of the plurality of refrigerant pipes including a respective row portion, and a plurality of air intakes that are configured to draw interior air in the interior area of the pantry and provide the interior air to an area adjacent to a second surface of the cover, and wherein the row portions of the plurality of refrigerant pipes includes a first group of row portions that is adjacent to the duct structure and a second group of row portions that is adjacent to the plurality of air intakes.

20. The refrigerator of claim 1, wherein the cover includes:

a plurality of ridges that protrude toward the through hole and that support the duct structure.

* * * * *